US009163495B2

(12) United States Patent
Hallundbæk et al.

(10) Patent No.: US 9,163,495 B2
(45) Date of Patent: Oct. 20, 2015

(54) FRACTURING SYSTEM

(75) Inventors: Jørgen Hallundbæk, Græsted (DK); Paul Hazel, Aberdeen (GB)

(73) Assignee: WELLTEC A/S, Allerød (DK)

( * ) Notice: Subject to any disclaimer, the term of this patent is extended or adjusted under 35 U.S.C. 154(b) by 355 days.

(21) Appl. No.: 13/807,857

(22) PCT Filed: Jun. 30, 2011

(86) PCT No.: PCT/EP2011/061033

§ 371 (c)(1),
(2), (4) Date: Dec. 31, 2012

(87) PCT Pub. No.: WO2012/001118

PCT Pub. Date: Jan. 5, 2012

(65) Prior Publication Data

US 2013/0098621 A1 Apr. 25, 2013

(30) Foreign Application Priority Data

Jun. 30, 2010 (EP) ..... 10167951

(51) Int. Cl.
*E21B 43/26* (2006.01)
*E21B 43/10* (2006.01)
*E21B 33/127* (2006.01)

(52) U.S. Cl.
CPC ..... *E21B 43/26* (2013.01); *E21B 43/103* (2013.01); *E21B 33/127* (2013.01)

(58) Field of Classification Search
CPC ... E21B 43/103; E21B 43/105; E21B 43/108; E21B 43/112; E21B 43/26; E21B 33/127
See application file for complete search history.

(56) References Cited

U.S. PATENT DOCUMENTS

| | | | | |
|---|---|---|---|---|
| 2,798,557 A | | 7/1957 | Sewell | |
| 2,923,358 A | | 2/1960 | Hildebrandt | |
| 3,062,294 A | | 11/1962 | Huitt et al. | |
| 3,924,677 A | * | 12/1975 | Prenner et al. | 166/100 |
| 5,325,923 A | | 7/1994 | Surjaatmadja et al. | |
| 5,396,957 A | | 3/1995 | Surjaatmadja et al. | |
| 5,425,424 A | * | 6/1995 | Reinhardt et al. | 166/291 |

(Continued)

FOREIGN PATENT DOCUMENTS

| | | |
|---|---|---|
| CN | 1308705 A | 8/2001 |
| CN | 1708631 A | 12/2005 |

(Continued)

OTHER PUBLICATIONS

International Search Report for PCT/EP2011/061033 mailed Aug. 8, 2011.

(Continued)

*Primary Examiner* — Robert E Fuller
*Assistant Examiner* — Christopher Sebesta
(74) *Attorney, Agent, or Firm* — Nixon & Vanderhye, P.C.

(57) ABSTRACT

The present invention relates to a fracturing system for fracturing a formation surrounding a well tubular structure, comprising a tubular part to be mounted as a part of the well tubular structure, the tubular part being made of metal, an expandable sleeve made of metal, the sleeve having a wall thickness and surrounding the tubular part, a fastening means for connecting the sleeve with the tubular part, and an aperture in the tubular part or the fastening means. Furthermore, the invention relates to a fracturing method for fracturing a formation surrounding a well tubular structure.

20 Claims, 10 Drawing Sheets

(56) References Cited

U.S. PATENT DOCUMENTS

| | | | | |
|---|---|---|---|---|
| 7,225,872 | B2 | 6/2007 | Zupanick | |
| 2002/0195245 | A1 | 12/2002 | Lauritzen et al. | |
| 2005/0121203 | A1* | 6/2005 | Richard et al. | 166/380 |
| 2005/0161232 | A1* | 7/2005 | Patel et al. | 166/386 |
| 2006/0131020 | A1 | 6/2006 | Zupanick | |
| 2008/0035345 | A1 | 2/2008 | Kosakewich | |
| 2008/0035349 | A1* | 2/2008 | Richard | 166/308.1 |
| 2008/0142219 | A1* | 6/2008 | Steele et al. | 166/281 |
| 2008/0296019 | A1* | 12/2008 | Johnson et al. | 166/278 |
| 2008/0296024 | A1* | 12/2008 | Huang et al. | 166/311 |
| 2009/0044944 | A1* | 2/2009 | Murray et al. | 166/308.1 |

FOREIGN PATENT DOCUMENTS

| | | | |
|---|---|---|---|
| CN | 101410588 | A | 4/2009 |
| WO | WO 2009/001069 | | 12/2008 |

OTHER PUBLICATIONS

Written Opinion of the International Searching Authority mailed Aug. 8, 2011.

International Preliminary Report on Patentability for PCT/EP2011/061033, issued Jan. 8, 2013 6 pages.

Chinese Office Action mailed Jan. 29, 2015 in Chinese Application No. 201180032240.4, with partial English Translation (10 pages).

* cited by examiner

FRACTURING SYSTEM

This application is the U.S. national phase of International Application No. PCT/EP2011/061033 filed 30 Jun. 2011 which designated the U.S. and claims priority to EP 10167951.2 filed 30 Jun. 2010, the entire contents of each of which are hereby incorporated by reference.

FIELD OF THE INVENTION

The present invention relates to a fracturing system for fracturing a formation surrounding a well tubular structure, comprising a tubular part to be mounted as a part of the well tubular structure, the tubular part being made of metal, an expandable sleeve made of metal, the sleeve having a wall thickness and surrounding the tubular part, a fastening means for connecting the sleeve with the tubular part, and an aperture in the tubular part or the fastening means. Furthermore, the invention relates to a fracturing method for fracturing a formation surrounding a well tubular structure.

BACKGROUND ART

In a wellbore, the formation is fractured in order to let oil pass into the wellbore and further on to the production casing. When fracturing the formation, it is desirable to obtain fractures extending substantially transversely to the extension of the borehole, and thus the casing. However, these fractures commonly extend substantially along the casing due to the natural layers in the formation.

Fractures extending perpendicularly to the casing extend longer into the formation. In this way, they uncover a larger area of the formation filled with oil containing fluid, which leads to a more optimised production than with longitudinal fractures.

SUMMARY OF THE INVENTION

It is an object of the present invention to wholly or partly overcome the above disadvantages and drawbacks of the prior art. More specifically, it is an object to provide an improved fracturing system which is capable of making fractures substantially perpendicularly to the production casing.

The above objects, together with numerous other objects, advantages, and features, which will become evident from the below description, are accomplished by a solution in accordance with the present invention by a fracturing system for fracturing a formation surrounding a well tubular structure, comprising:

- a tubular part to be mounted as a part of the well tubular structure, the tubular part being made of metal,
- an expandable sleeve made of metal, the sleeve having a wall thickness and surrounding the tubular part,
- a fastening means for connecting the sleeve with the tubular part, and
- an aperture in the tubular part or the fastening means, wherein the sleeve has a fracture initiating element.

In an embodiment, the fracturing initiating element may project from a surface of the sleeve.

By a fracture initiating element projecting from the surface of the sleeve is meant a position along the surface in which a slope of a tangent to the surface changes from zero to a non-zero value, returns to zero at a peak, and then changes again to a non-zero value of the opposite sign before returning to the original zero slope, the element projecting in this position towards the formation.

Moreover, the fracture initiating element may at least partly penetrate part of the formation in an expanded condition of the expandable sleeve.

Further, the expandable sleeve may have an expanded condition in which a contact surface of the sleeve contacts the formation and an unexpanded condition, the fracture initiating element projecting at least in the expanded position from the contact surface into the formation in order to fracture the formation.

In an embodiment of the invention, the fracture initiating element may be arranged between the fastening means.

Furthermore, the fracture initiating element may comprise a centre part of the sleeve having a decreased wall thickness in relation to another part of the sleeve.

In addition, the fracture initiating element may comprise several areas distributed along a circumference of the sleeve, and the areas of the sleeve may have a decreased wall thickness in relation to other areas of the sleeve.

Moreover, the fracture initiating element may comprise a projection.

Additionally, the fracture initiating element may comprise a shear plug, a spring-loaded valve or a rupture disc.

In an embodiment, the projection may taper away from the tubular part towards the formation.

Furthermore, the projection may be a circumferential projection.

Additionally, the sleeve may have a plurality of projections along its circumference to ensure that the projections are arranged in the same circumferential cross-sectional plane of the sleeve.

In another embodiment, the fracture initiating element may comprise at least one area having a decreased wall thickness which bursts when it reaches a predetermined pressure.

The fracturing system as described above may further comprise a tool for expanding the expandable sleeve by letting a pressurised fluid through an aperture in the tubular part into a space between the expandable sleeve and the tubular part.

Furthermore, a valve may be arranged in the aperture to control the passage of pressurised fluid into the space between the expandable sleeve and the tubular part.

In addition, the sleeve may have two ends made of a different material than a centre part of the sleeve.

These two ends may be welded to the centre part, and they may have an inclined surface corresponding to an inclined surface of the centre part of the sleeve.

In an embodiment, the valve may be a one-way valve or a two-way valve.

In another embodiment, at least one of the fastening means may be slidable in relation to the connection part of the tubular part of the annular barrier.

Furthermore, at least one of the fastening means may be fixedly fastened to the tubular part.

In yet another embodiment, the tool may have a means for moving the valve from one position to another.

Furthermore, the tool may have an isolation device for isolating a first section between an outside wall of the tool and an inside wall of the well tubular structure outside the aperture of the tubular part.

In addition, the isolation device of the tool may have at least one sealing means for sealing against the inside wall of the well tubular structure on each side of the valve in order to isolate the first section inside the well tubular structure.

Moreover, the tool may have a pressure delivering means for taking in fluid from the borehole and for delivering pressurised fluid to the first section.

Additionally, the tool may have a means for connecting the tool to a drill pipe. Also, the tool may have packers for closing an annular area.

The invention furthermore relates to the use of the fracturing system as described above in a well tubular structure for inserting the structure into a borehole.

Finally, the invention relates to a fracturing method for fracturing a formation surrounding a well tubular structure by expanding an expandable sleeve in the fracturing system as described above inside a borehole, the method comprising the steps of:

placing a tool outside the aperture of the tubular part, injecting fluid into the space between the tubular part and the expandable sleeve to expand the sleeve, fracturing the formation by expanding the sleeve until the sleeve applies a predetermined pressure on the formation.

Furthermore, the fracturing method may comprise the step of expanding the sleeve until the fracture initiating element bursts.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
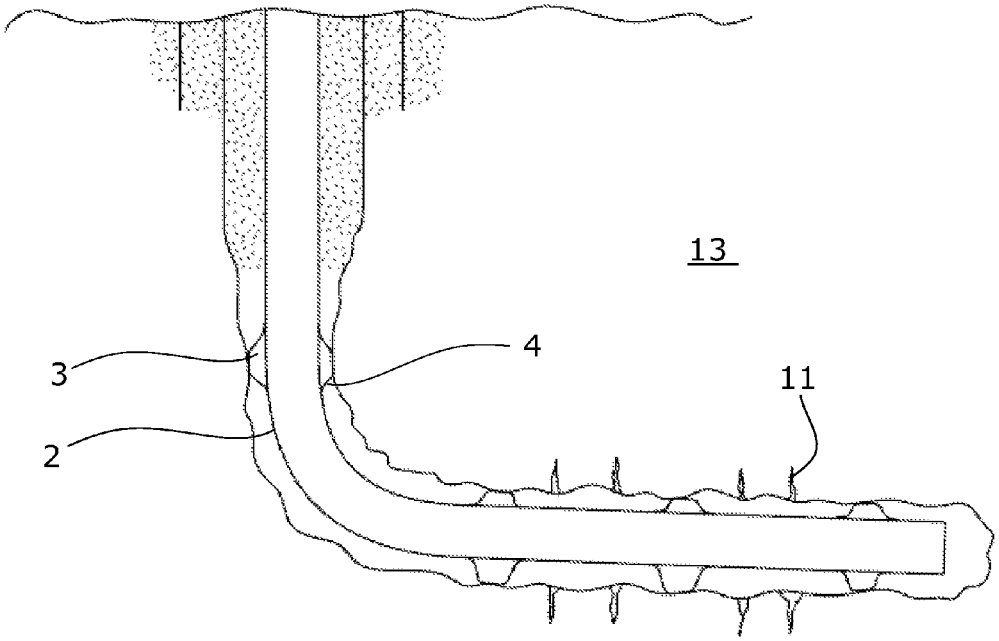
FIG. 1 shows a cross-sectional view of a casing in a wellbore having a horizontal part.
Figure 2:
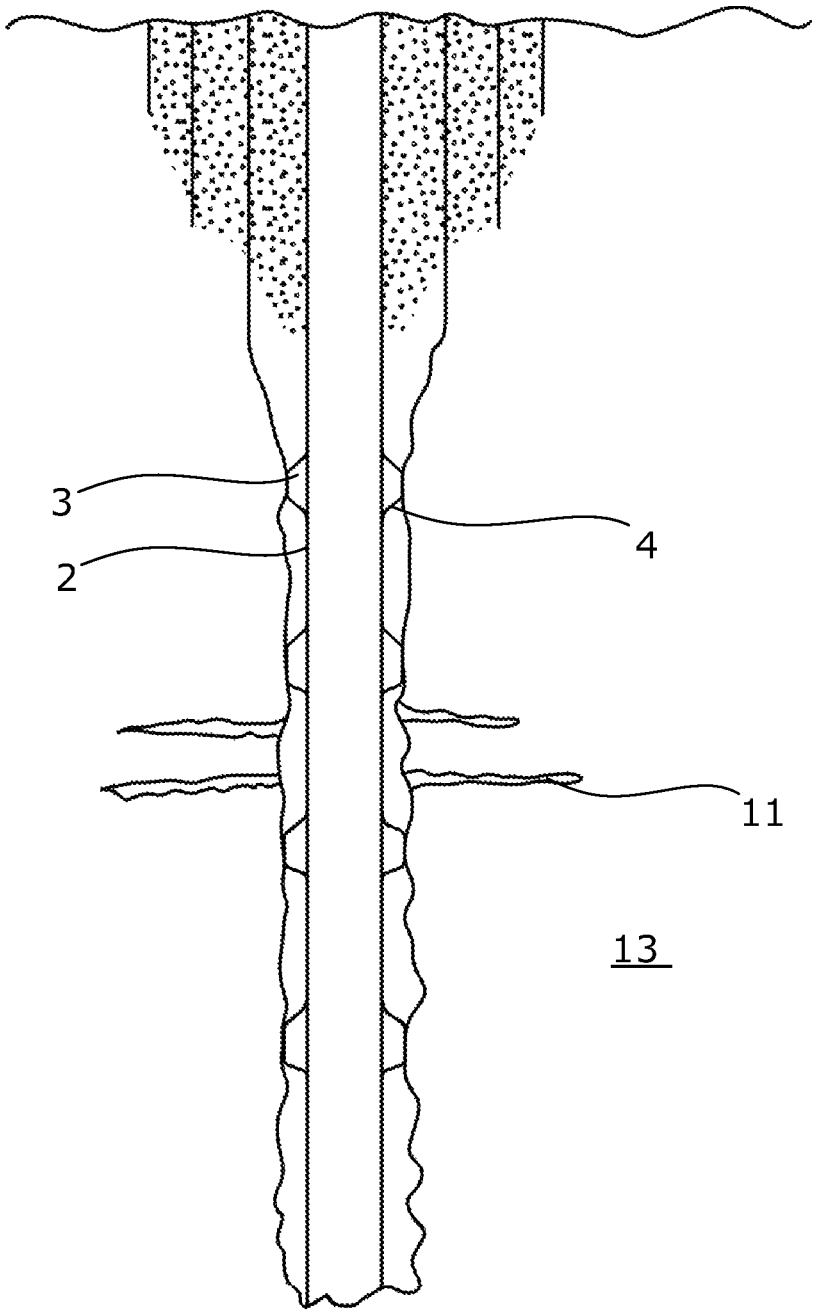
FIG. 2 shows a cross-sectional view of a casing in a vertical well.

FIG. 1 shows a well having a vertical and a horizontal part. In the horizontal part, formation fractures 11 extending perpendicularly to the production casing are shown. The production casing is fastened to the formation by means of annular barriers, and the fractures are situated between the expanded annular barriers in the horizontal part. In this kind of well, the fractures 11 are vertical and may also be perpendicular to the natural layers of the formation. A well which is only vertical is shown in FIG. 2. The well has annular barriers and horizontal fractures, all of which are also perpendicular and transverse to the production casing. In the following, both types of fractures 11 illustrated in FIGS. 1 and 2, which are perpendicular to the production casing, will be referred to as transverse fractures.

Figure 3:
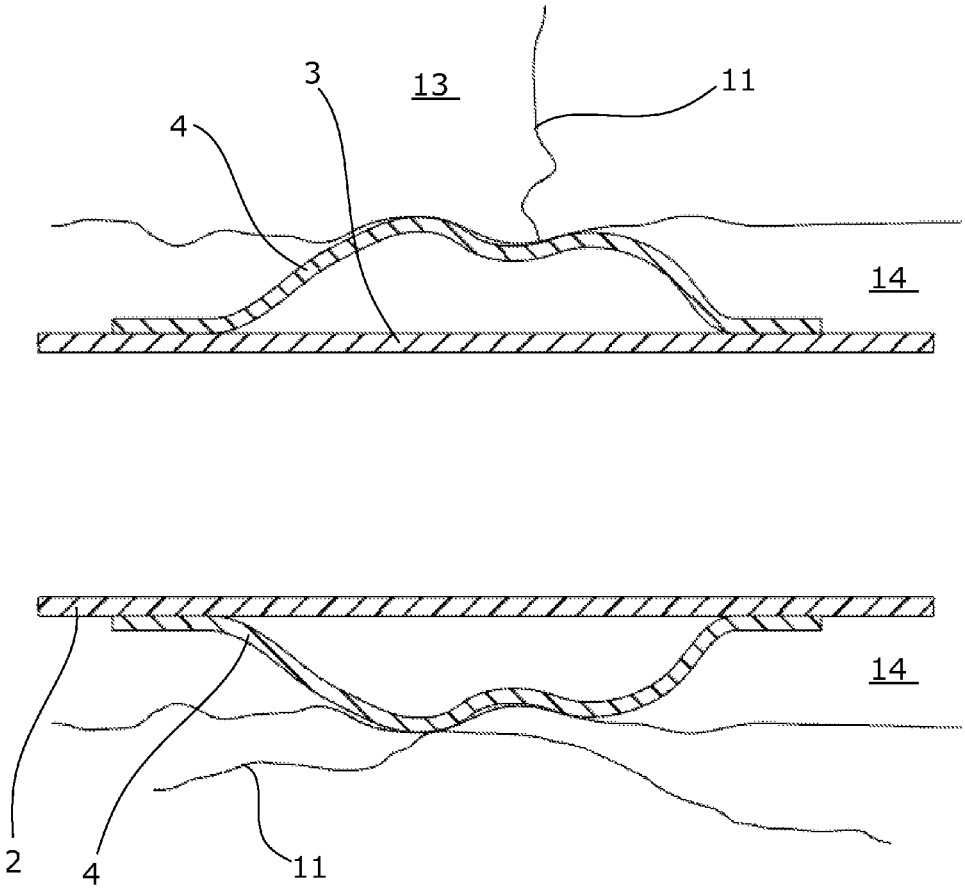
FIG. 3 shows a cross-sectional view of an expanded sleeve creating fractures in the formation.

FIG. 3 shows an illustration of an expanded sleeve 4 creating transverse fractures 11 in the formation above the sleeve and longitudinal fractures in the formation below the sleeve. As can be seen, longitudinal fractures are fractures extending along the extension of the production casing. Estimates made in the oil industry show that a horizontal well having transverse formation fractures improves the production efficiency by up to 60% compared to a horizontal well having longitudinal fractures.

By expanding the sleeve 4 in an annular barrier to create fractures in the formation, the expanded sleeve presses against the formation, causing the fractures to become coincidental.

Figure 4:
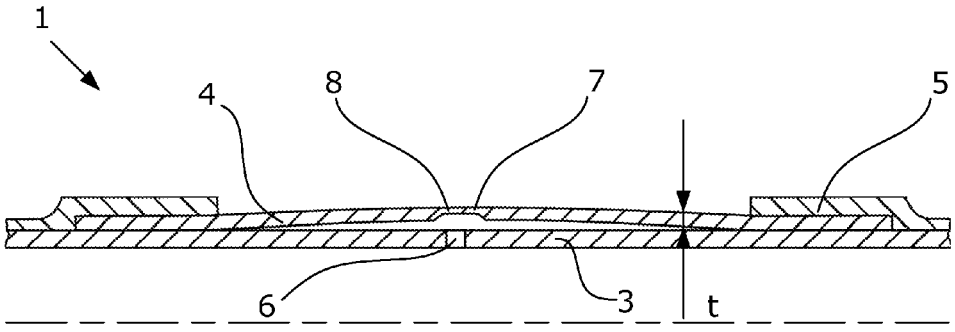
FIG. 4 shows a cross-sectional view of an unexpanded fracturing system.
Figure 5:
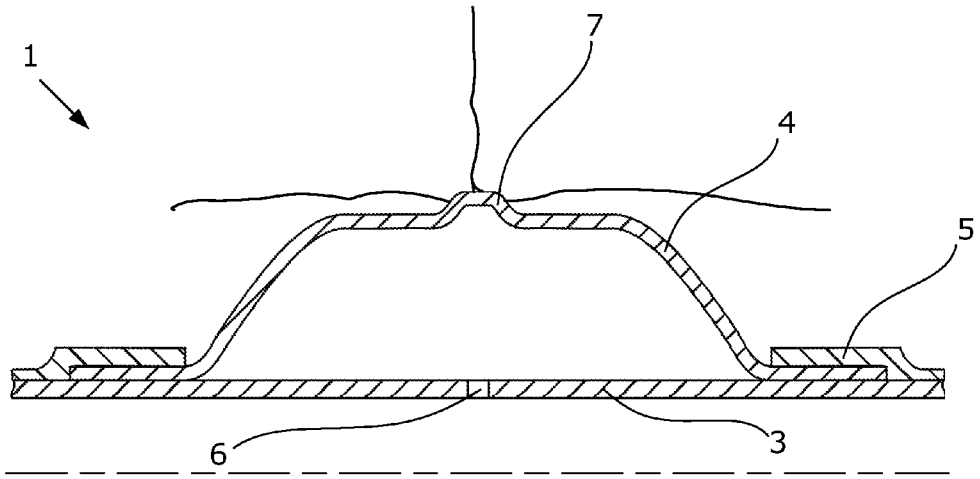
FIG. 5 shows a cross-sectional view of the fracturing system of FIG. 4 in an expanded condition.

FIG. 4 shows a fracturing system 1 comprising a sleeve 4 with a fracture initiating element 7. The fracture initiating element 7 is in this embodiment a part of the sleeve 4 having an decreased wall thickness so that when the sleeve is expanded, as shown in FIG. 5, the fracture initiating element 7 projects and functions as a notch when pressed towards the formation. In this way, the fracturing process is controlled to ensure that the fractures are transverse instead of longitudinal.

The fracturing system 1 comprises an expandable sleeve 4 and a tubular metal part 3, both of which are mounted as a part of the well tubular structure 2 when inserting the production casing in the borehole. As illustrated in FIG. 4, the expandable sleeve 4 has a wall thickness t in its unexpanded condition and surrounds the tubular part 3 and is sealingly fastened to the tubular part by means of a fastening means 5. The tubular part 3 has at least one aperture 6 functioning as a passage for letting fluid into the space between the sleeve 4 and the tubular part to expand the sleeve.

Figure 6:
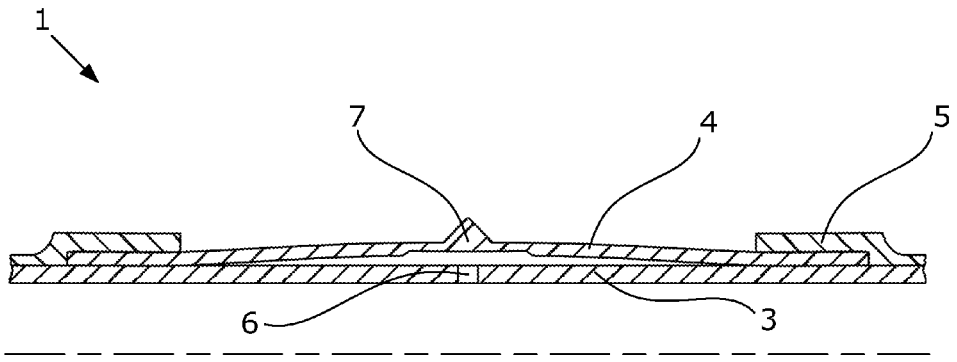
FIG. 6 shows a cross-sectional view of an embodiment of an unexpanded fracturing system.
Figure 7:
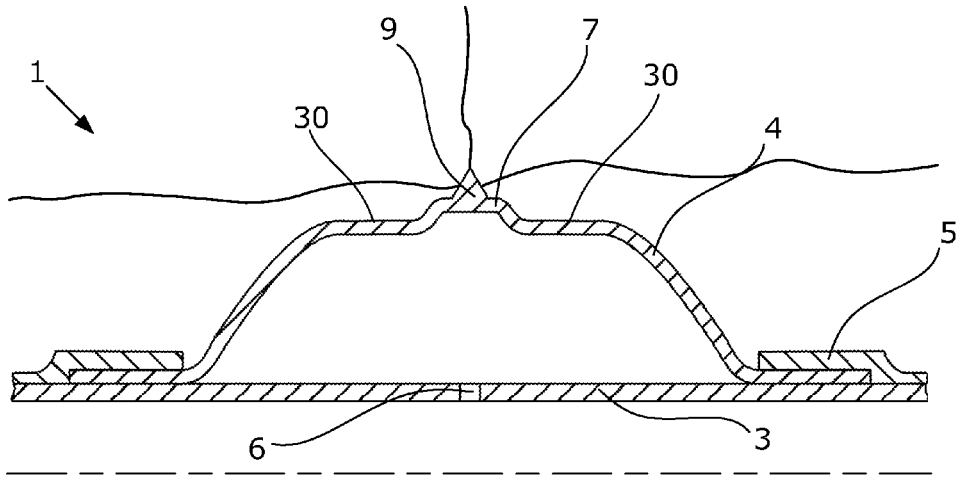
FIG. 7 shows a cross-sectional view of the fracturing system of FIG. 6 in an expanded condition.

In the fracturing system 1 of FIG. 6, the expandable sleeve 4 has a fracture initiating element 7 which is a part of the sleeve having a decreased wall thickness, as shown in FIG. 4. Furthermore, the fracture initiating element 7 comprises a projection 9 tapering into a circumferential rim. The sleeve 4 of FIG. 6 is shown in its expanded condition in FIG. 7 in which the part of the sleeve having a decreased thickness projects towards the formation as a projecting part, and the rim arranged on the projecting part having a decreased thickness presses against the formation and increases the notch effect of the projecting part.

Thus, in FIGS. 5-9, 11 and 14-16, the fracturing initiating element projects from a surface of the sleeve. By a fracture initiating element projecting from the surface of the sleeve is meant a position along the surface in which a slope of a tangent to the surface changes from zero to a non-zero value, returns to zero at a peak, and then changes again to a non-zero value of the opposite sign before returning to the original zero slope, the element projecting in this position from the surface of the sleeve and towards the formation.

In FIGS. 5, 7, 11 and 15, the fracture initiating element at least partly penetrates part of the formation in an expanded condition of the expandable sleeve. After penetration of part of the fracture initiating element, a contact surface 30 being another part of the sleeve contacts the formation.

In another embodiment, the expandable sleeve 4 has a plurality of fracture initiating elements 7 in the form of parts of the sleeve having a decreased wall thickness. The sleeve 4 has several circular areas having a decreased thickness, and on the outside of the sleeve each fracture initiating element comprises a projection 9 tapering towards a point.

Figure 8:
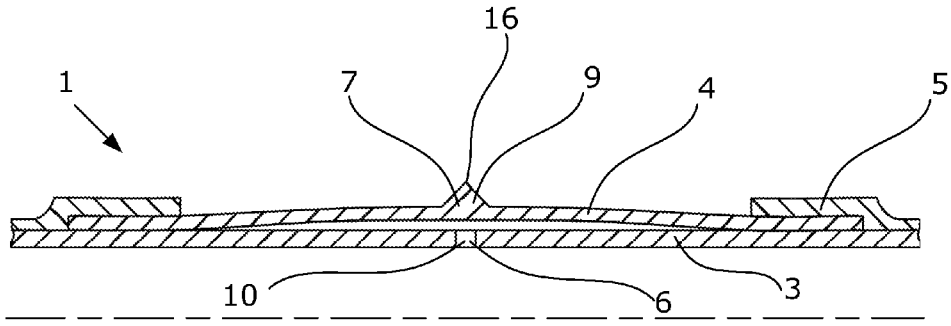
FIG. 8 shows a cross-sectional view of yet another embodiment of an unexpanded fracturing system.
Figure 9:
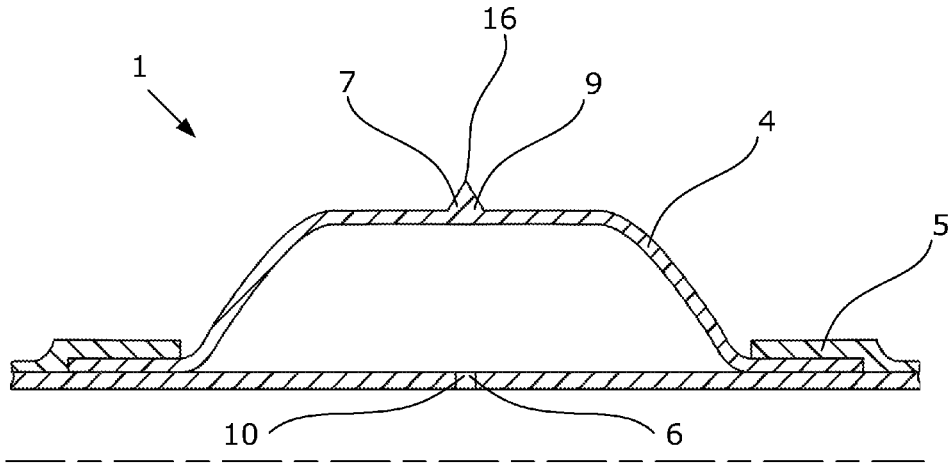
FIG. 9 shows a cross-sectional view of the fracturing system of FIG. 8 in an expanded condition.

The sleeve 4 of FIG. 8 comprises a plurality of fracture initiating elements 7 in the form of projections 9 arranged on the outside of the sleeve in the same cross-sectional plane of the sleeve transverse to the longitudinal direction of the casing. Each projection 9 tapers towards a point 16 which is pressed into the formation when the sleeve 4 is expanded, and the point 16 of each projection 9 functions as a notch initiating a fracture transverse to the longitudinal direction of the casing when the sleeve is expanded, as shown in FIG. 9.

As shown in FIG. 8, the aperture 6 may have a valve 10 which must be opened before pressurised fluid 12 can be injected into the space between the sleeve 4 and the tubular part 3 in order to expand the sleeve.

Figure 10:
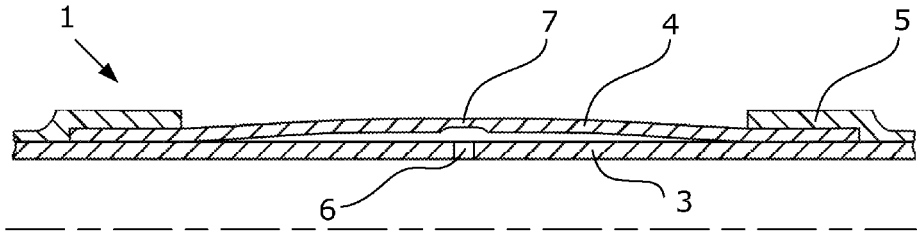
FIG. 10 shows a cross-sectional view of yet another embodiment of an unexpanded fracturing system.
Figure 11:
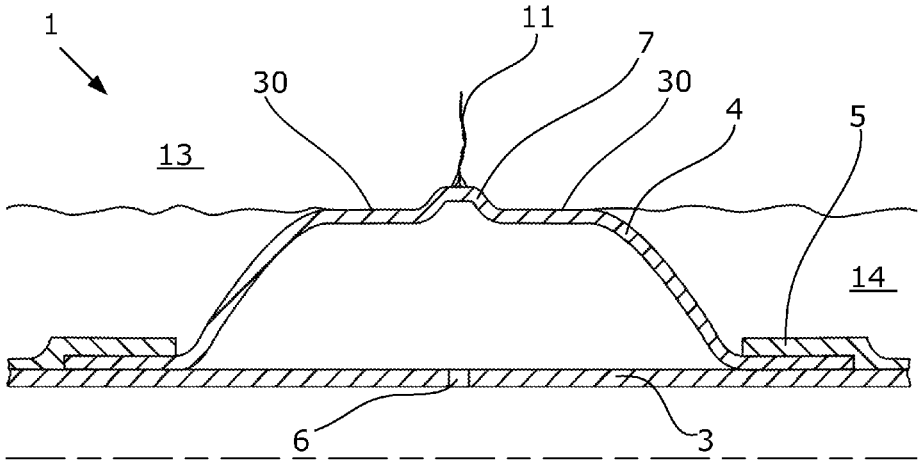
FIG. 11 shows a cross-sectional view of the fracturing system of FIG. 10 in its almost fully expanded condition.
Figure 12:
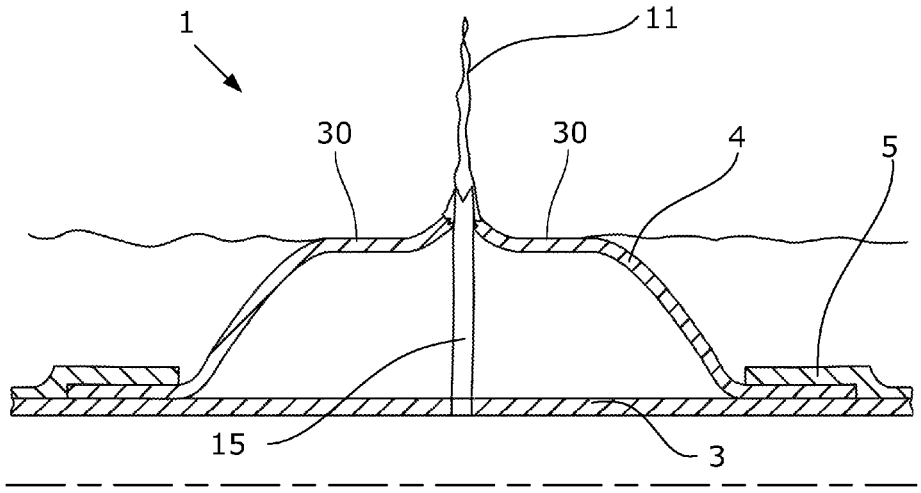
FIG. 12 shows a cross-sectional view of the fracturing system of FIG. 10 in its fully expanded condition, in which the fracture initiating element burst so to let fluid fracture the formation.

In FIGS. 10-12, the fracturing system 1 has a plurality of fracture initiating elements 7 in the form of areas having a decreased wall thickness. When the sleeve 4 is expanded, as shown in FIG. 11, the areas having a decreased wall thickness project from the outside of the sleeve towards the formation, and when being further expanded, the areas burst, as shown in FIG. 12. Thus, the fracture initiating elements 7 function as notches creating fractures 11 in the formation, and when they burst, fluid 15 can be injected into the formation wall at a high pressure, thereby fracturing the formation even further. If the fluid 15 comprises acid, the fractures 11 can be enlarged by means of the acid.

Figure 13:
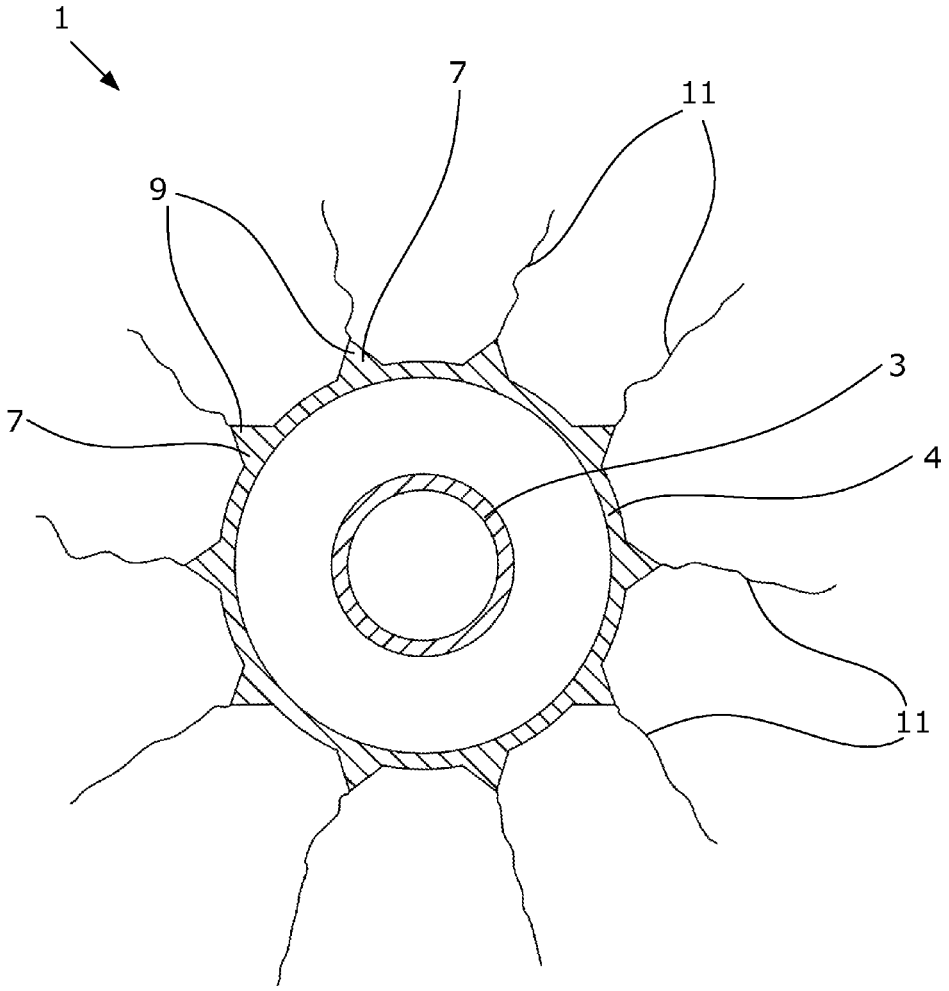
FIG. 13 shows a cross-sectional view transversely through the fracture initiating elements of FIG. 9.

As mentioned, it is desirable to have transverse fractures, and by having a plurality of fracture initiating elements 7 in the same cross-sectional plane, controlled transverse fractures are easily made in the same cross-sectional plane transverse to the longitudinal direction of the production casing. Hereby, a more efficient fracturing system 1 is provided, controlling the fracturing direction of the fractures. In FIG. 13, a cross-sectional view transverse to the longitudinal extension of the fracturing system through the sleeve and the fracture initiating elements are shown with transverse fractures in the same cross-sectional plane. Furthermore, the fracture elements are shown spaced along the circumference of the sleeve.

Figure 14:
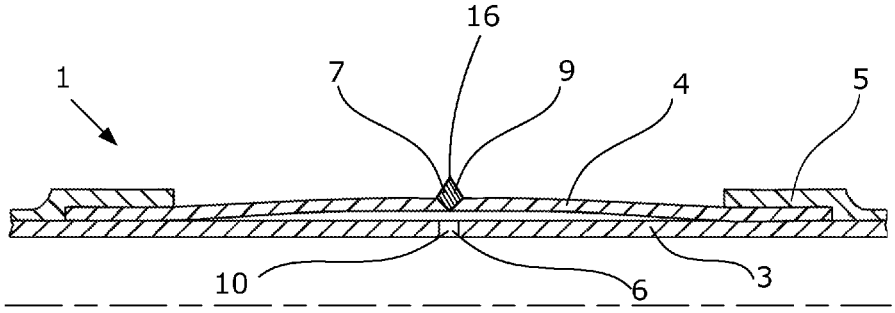
FIG. 14 shows a cross-sectional view of yet another embodiment of an unexpanded fracturing system.
Figure 15:
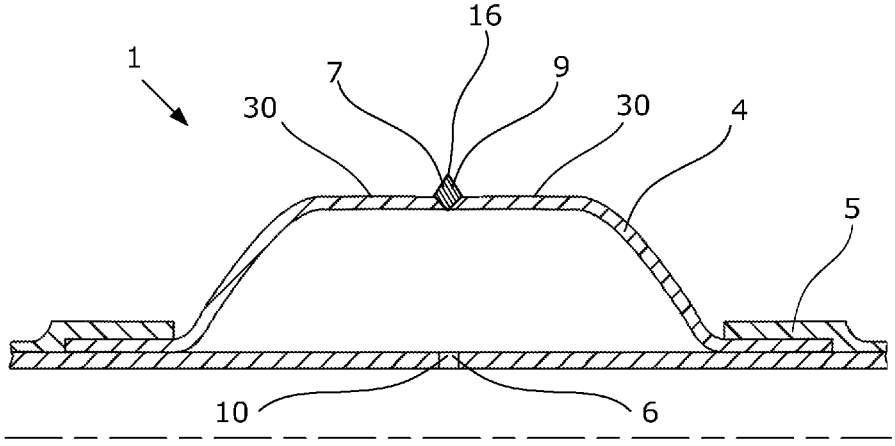
FIG. 15 shows a cross-sectional view of the fracturing system of FIG. 14 in an expanded condition.
Figure 16:
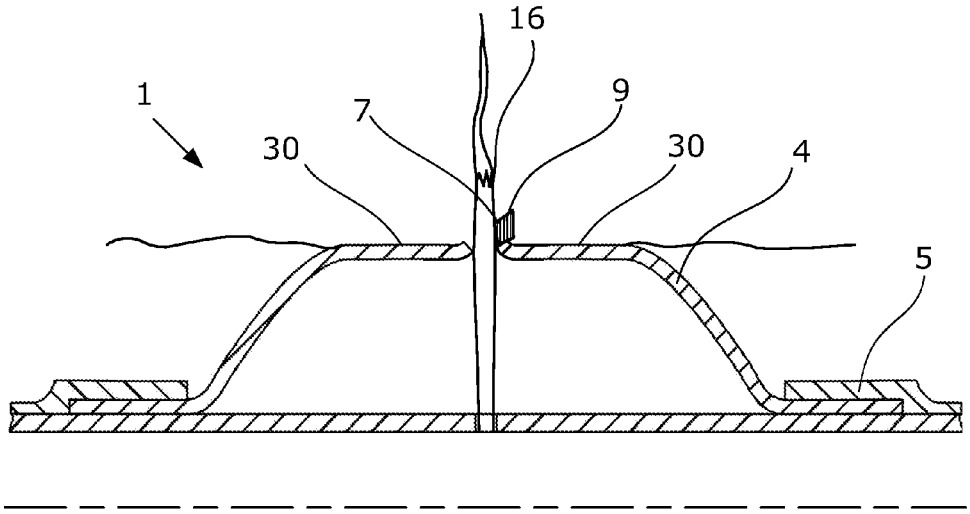
FIG. 16 shows a cross-sectional view of the fracturing system of FIG. 14 in its fully expanded condition in which the fracture initiating element has been released from the sleeve so to let fluid fracture the formation.

An unexpanded fracturing system in which the fracture initiating element is a shear plug fastened in the wall of the sleeve is shown in the cross-sectional view of FIG. 14. The fracture initiating element partly penetrates the formation as shown in FIG. 15 and is releasable from the sleeve when a certain pressure is injected into the aperture 6 so that the fracture initiating element leaves an open hole in the wall of the sleeve. In FIG. 16, fracturing fluid is penetrating the hole in the sleeve wall and further into the fracture in the formation.

Instead of a shear plug as shown in FIGS. 14-16, the fracture initiating element may be a spring-loaded valve or a rupture disc. The fracture initiating element may also be a pointed element being welded as part of the wall of the sleeve, and thus the welding connection breaks at a certain fluid pressure injected through the aperture 6.

The well tubular structure 2 may be the production tubing or casing, or a similar kind of tubing downhole in a well or a borehole.

The valve 10 may be any kind of valve capable of controlling a flow, such as a ball valve, a butterfly valve, a choke valve, a check valve or non-return valve, a diaphragm valve, an expansion valve, a gate valve, a globe valve, a knife valve, a needle valve, a piston valve, a pinch valve or a plug valve.

The expandable tubular metal sleeve 4 may be a cold-drawn or hot-drawn tubular structure.

The fluid used for expanding the expandable sleeve 4 may be any kind of well fluid present in the borehole surrounding the tool 20 and/or the well tubular structure 3. Also, the fluid may be cement, gas, water, polymers or a two-component compound, such as powder or particles, mixing or reacting with a binding or hardening agent.

Although the invention has been described in the above in connection with preferred embodiments of the invention, it will be evident for a person skilled in the art that several modifications are conceivable without departing from the invention as defined by the following claims.

The invention claimed is:

1. A fracturing system for fracturing a formation surrounding a well tubular structure, comprising:

a tubular part to be mounted as a part of the well tubular structure, the tubular part being made of metal, an axially-oriented expandable sleeve made of metal, the sleeve having a wall thickness and surrounding the tubular part, a fastening means for connecting the sleeve with the tubular part, and an aperture in the tubular part, wherein the sleeve has a fracture initiating element, the fracture initiating element comprising at least one area of the sleeve having a decreased wall thickness, the at least one area being configured to project laterally outward from the sleeve at least under pressure and burst when the at least one area reaches a predetermined pressure.

2. The fracturing system according to claim 1, wherein the expandable sleeve has (1) an expanded condition in which a contact surface of the sleeve contacts the formation and (2) an unexpanded condition; the fracture initiating element being configured to project from the contact surface into the formation in the expanded condition, the fracture initiating element being configured to fracture the formation.

3. The fracturing system according to claim 1, wherein the fracture initiating element comprises a centre part of the sleeve having a decreased wall thickness in relation to another part of the sleeve.

4. The fracturing system according to claim 1, wherein the fracture initiating element comprises several areas distributed along a circumference of the sleeve, and wherein the areas of the sleeve have a decreased wall thickness in relation to other areas of the sleeve.

5. The fracturing system according to claim 1, wherein the fracture initiating element comprises a projection.

6. The fracturing system according to claim 5, wherein the fracture initiating element comprises a shear plug.

7. The fracturing system according to claim 5, wherein the projection tapers away from the tubular part towards the formation.

8. The fracturing system according to claim 5, wherein the projection is a circumferential projection.

9. The fracturing system according to claim 5, wherein the sleeve has a plurality of projections along its circumference to ensure that the projections are arranged in the same circumferential cross-sectional plane of the sleeve.

10. The fracturing system according to claim 1, further comprising a tool for expanding the expandable sleeve by letting a pressurised fluid through an aperture in the tubular part into a space between the expandable sleeve and the tubular part.

11. The fracturing system according to claim 1, wherein a valve is arranged in the aperture to control the passage of pressurised fluid into the space between the expandable sleeve and the tubular part.

12. The fracturing system according to claim 1, wherein the aperture fluidly connects an interior of the tubular part and a space between the sleeve and the tubular part.

13. The fracturing system according to claim 5, wherein the fracture initiating element comprises a spring-loaded valve.

14. The fracturing system according to claim 5, wherein the fracture initiating element comprises a rupture disc.

15. A method of fracturing a formation surrounding a well tubular structure comprising: inserting the structure according to claim 1 into a borehole; and expanding the expandable sleeve to an expanded condition wherein the fracture initiating element contacts the formation.

16. A fracturing method for fracturing a formation surrounding a well tubular structure by expanding an expandable sleeve in the fracturing system according to claim 1 inside a borehole, the method comprising the steps of:

placing a tool outside the aperture of the tubular part, injecting fluid into the space between the tubular part and the expandable sleeve to expand the sleeve, fracturing the formation by expanding the sleeve until the sleeve applies a predetermined pressure on the formation.

17. The fracturing method according to claim 16, further comprising the step of expanding the sleeve until the fracture initiating element bursts.

18. A downhole system for fracturing a formation surrounding a well tubular structure, comprising:

a tubular part made of metal, the tubular part being mounted as a part of the well tubular structure;

an axially-oriented expandable sleeve made of metal, the sleeve being arranged laterally outward from and surrounding the tubular part and having a sleeve wall thickness;

a fastening means configured to connect the sleeve with the tubular part; and an aperture in the tubular part configured to fluidly connect an interior of the well tubular structure with a sleeve space between the sleeve and the tubular part; and a fracture initiating element;

wherein the fracture initiating element is configured to project laterally outward from the sleeve at least under pressure and cause fracturing in the formation upon contact with the formation; and the fracture initiating element is configured to burst when a fracture initiating area on an interior surface of the sleeve corresponding to a location of the fracture initiating element reaches a predetermined pressure.

19. The downhole system according to claim 18, wherein the fracture initiating area comprises a section of the sleeve with a decreased wall thickness.

20. The downhole system according to claim 18, wherein the fracture initiating area is configured to expand further laterally than the sleeve under pressure.

* * * * *